US006595689B1

(12) United States Patent
Borchardt et al.

(10) Patent No.: US 6,595,689 B1
(45) Date of Patent: Jul. 22, 2003

(54) CLOSURE DEVICE

(75) Inventors: Michael G. Borchardt, Naperville, IL (US); Alan F. Savicki, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 09/980,449

(22) PCT Filed: Jun. 10, 1999

(86) PCT No.: PCT/US99/13248

§ 371 (c)(1),
(2), (4) Date: Nov. 14, 2001

(87) PCT Pub. No.: WO00/76352

PCT Pub. Date: Dec. 21, 2000

(51) Int. Cl.[7] ..... B65D 33/16
(52) U.S. Cl. ..... 383/64; 24/399; 24/400
(58) Field of Search ..... 383/64; 24/399, 24/400

(56) References Cited

U.S. PATENT DOCUMENTS 5,067,208 A 11/1991 Herrington, Jr.
5,088,971 A 2/1992 Herrington, Jr.
5,131,121 A 7/1992 Herrington, Jr.
5,161,286 A 11/1992 Herrington, Jr. et al.
5,669,715 A * 9/1997 Dobreski et al. ..... 383/5
5,950,285 A * 9/1999 Porchia et al. ..... 24/400
6,088,887 A * 7/2000 Bois ..... 24/399
6,287,001 B1 * 9/2001 Buchman ..... 383/64
6,293,701 B1 * 9/2001 Tomic ..... 383/64

* cited by examiner

*Primary Examiner*—Jes F. Pascua
(74) *Attorney, Agent, or Firm*—Thomas C. Feix

(57) ABSTRACT

A closure device (121) with interlocking fastening strips (130, 131) and a slider (132) that establishes a leak proof plastic bag (120). The ends of the fastening strips are heat sealed, melted or otherwise secured together. The fastening strips (130, 131) include a second seal (129) disposed in close proximity to one of the ends of the fastening strips. The second seal (129) is formed by heat sealing to melt the fastening strips together. The second seal (129) prevents the separator (172) of the slider from deoccluding or forming a gap when the slider (132) is at the occluded end. The second seal (129) extends midway up the fastening strips (130, 131) so that the separator (172) moves over the second seal (129) during movement of the slider towards the end. An unmelted portion (119) of the fastening strips (130, 131) is disposed between the second seal (129) and the end of the fastening strips to maintain the guide rails (139, 143) and to prevent the slider (132) from disengaging the fastening strips (130, 131).

30 Claims, 11 Drawing Sheets

CLOSURE DEVICE

FIELD OF THE INVENTION

The present invention relates generally to closure devices and, more particularly, to interlocking fastening strips that are occluded and deoccluded by a slider. The inventive closure devices may be employed in traditional fastener areas, and is particularly well suited for fastening flexible storage containers, including plastic bags.

BACKGROUND OF THE INVENTION

The use of closure devices for fastening storage containers, including plastic bags, is generally well known. Furthermore, the manufacture of closure devices made of plastic materials is generally known to those skilled in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the side walls of the container are integrally formed by extrusion as a single piece. Alternatively, the closure device and side walls of the container may be formed as separate pieces and then connected by heat sealing or any other suitable connecting process. In either event, such closure devices are particularly useful in providing a closure means for retaining matter within the bag.

Conventional closure devices typically utilize mating fastening strips or closure elements which are used to selectively seal the bag. With such closure devices, however, it is often difficult to determine whether the fastening strips are fully occluded. This problem is particularly acute when the strips are relatively narrow. Accordingly, when such fastening strips are employed, there exists a reasonable likelihood that the closure device is at least partially open.

Such fastening strips devices are also particularly difficult to handle by individuals with limited manual dexterity. Thus, in order to assist these individuals and for ease of use by individuals with normal dexterity, the prior art has also provided sliders for use in opening and closing the fastening strips, as disclosed, for example, in U.S. Pat. Nos. 4,199,845, 5,007,142, 5,007,143, 5,010,627, 5,020,194, 5,070,583, 5,283,932, 5,301,394, 5,426,830, 5,431,760, 5,442,838, and 5,448,808. Many of these sliders include a separator which extends at least partially between the fastening strips. When the slider is moved in an appropriate direction towards one end of the fastening strips, the separator divides the fastening strips and opens the bag. Once the fastening strips are separated, the fastening strips can be relocked if desired by moving the slider in the opposite direction toward the other end of the fastening strips to reclose the bag.

One problem associated with using sliders is that the slider can cause the bags to leak. In particular, the separator of the slider can cause an unoccluded gap between the fastening strips when the slider is at the end of the bag when the bag is supposed to be fully closed. The gap may allow the bag to leak. Leaky bags are a disadvantage in many of the applications of closable plastic bags. For example, leaky bags will not store liquids unless the bag is properly oriented. Leaky bags can often cause a mess and/or damage to other items when liquids leak from the bags. If the bags are used for foods for refrigerator storage, leaky bags will communicate air in and out of the bag which can cause premature spoilage of the food inside the bag or the contents in the bag can undesirably generate an odor into the air inside the refrigerator.

SUMMARY OF THE INVENTION

The inventive leak-proof closure device is intended for use with a storage container which includes a pair of complementary sheets or opposing flexible side walls, such as a plastic bag. The closure device includes interlocking fastening strips disposed along respective edge portions of the opposing side walls, and a slider slidably disposed on the interlocking fastening strips. The slider facilitates the occlusion of the fastening strips when moved towards a first end thereof. The slider includes a separator that facilitates the deocclusion of the fastening strips when moved towards a second end thereof. The fastening strips are sealingly secured together at the first and second ends to prevent leakage from the container or bag. In accordance with the present invention, a second seal is provided in proximity to the first end that fixes the fastening strips together. The second seal prevents the formation of a gap at the first end by the separator when the fastening strips are fully closed and to thereby provide a leak-proof container.

According to an aspect of one embodiment, the second seal and the seals at the first and second ends are accomplished by heat sealing, ultrasonic sealing or other similar process that melts the plastic material of the fastening strips together. This may be accomplished in one heat sealing operation. In one embodiment, there is an unmelted portion between the second seal and the first end to prevent the slider from being removed from the fastening strips in the vertical Z axis from the first end.

These and other features and advantages of the present invention will become more readily apparent upon reading the following detailed description of exemplified embodiments and upon reference to the accompanying drawings herein.

Figure 1:
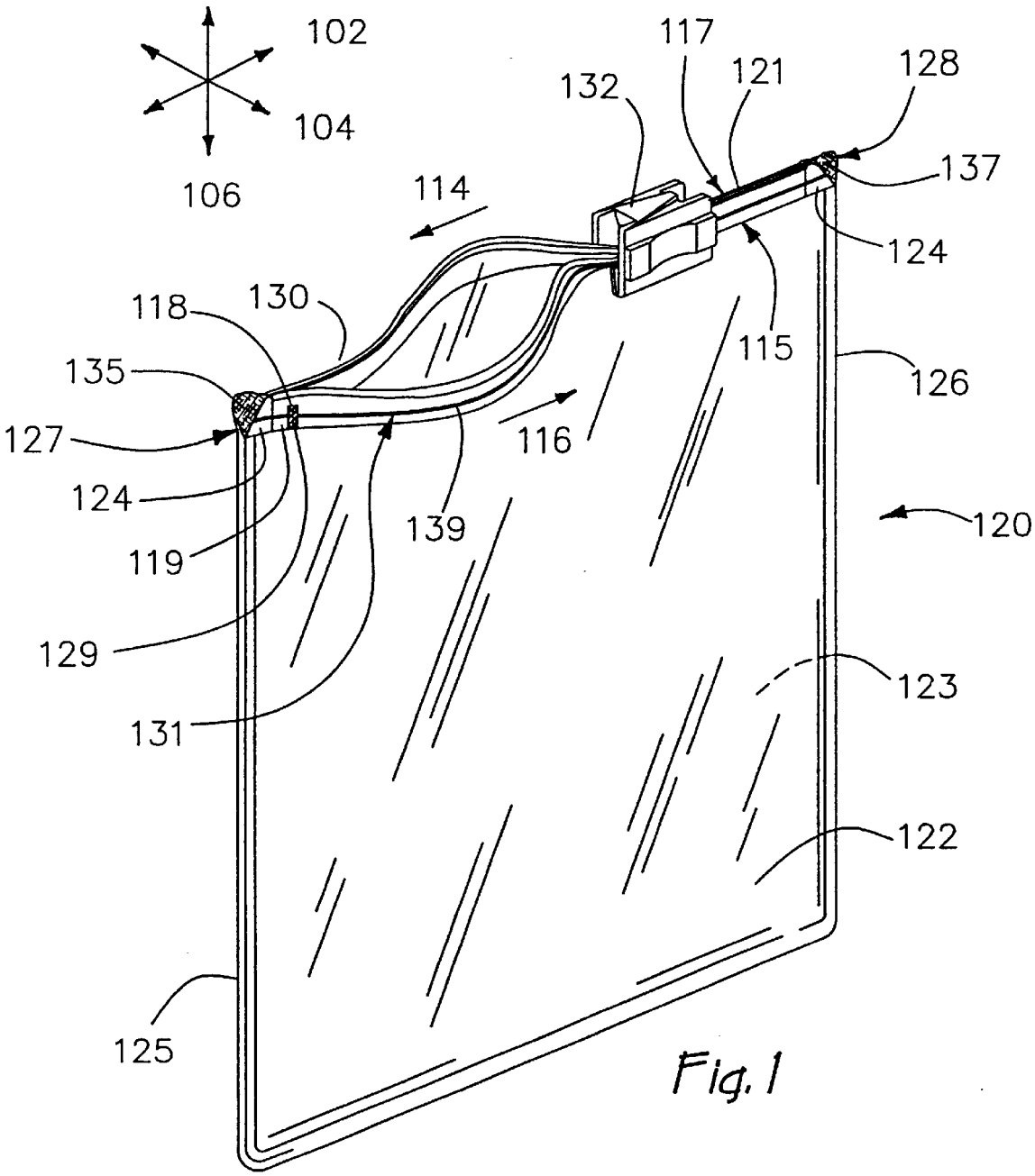
FIG. 1 is a perspective view of a container according to the present invention in the form of a plastic bag.

While the present invention will be described and disclosed in connection with certain embodiments and procedures, the intent is not to limit the present invention to these embodiments and procedures. On the contrary, the intent is to cover all such alternatives, modifications, and equivalents that fall within the spirit and scope of the present invention as defined by the appended claims.

DESCRIPTION OF THE EMBODIMENTS

FIGS. 1–4 illustrate a container in the form of a plastic bag 120 having a sealable closure device 121. The bag 120 includes side walls 122, 123 joined at seams 125, 126 to form a compartment sealable by means of the closure device 121. The closure device 121 comprises first and second fastening strips 130, 131 and a slider 132.

The fastening strips 130, 131 and the slider 132 have a longitudinal X axis 102 and a transverse Y axis 104 which is perpendicular to the longitudinal X axis 102. Also, the fastening strips have a vertical Z axis 106 which is perpendicular to the longitudinal X axis 102 and which is perpendicular to the transverse Y axis 104.

The fastening strips 130, 131 are adapted to be interlocked between a first end 127 and a second end 128. The fastening strips 130, 131 are secured together at the first and second ends 127, 128 to form end seals. As shown in the figures, the first and second ends 127, 128 preferably include melted portions 135, 137, in which the fastening strips 130, 131 are melted together by heat sealing, ultrasonic sealing or other operation to form the end seals. The first and second ends 127, 128 may alternatively be secured together by plastic clamps, or other means.

Figure 3:
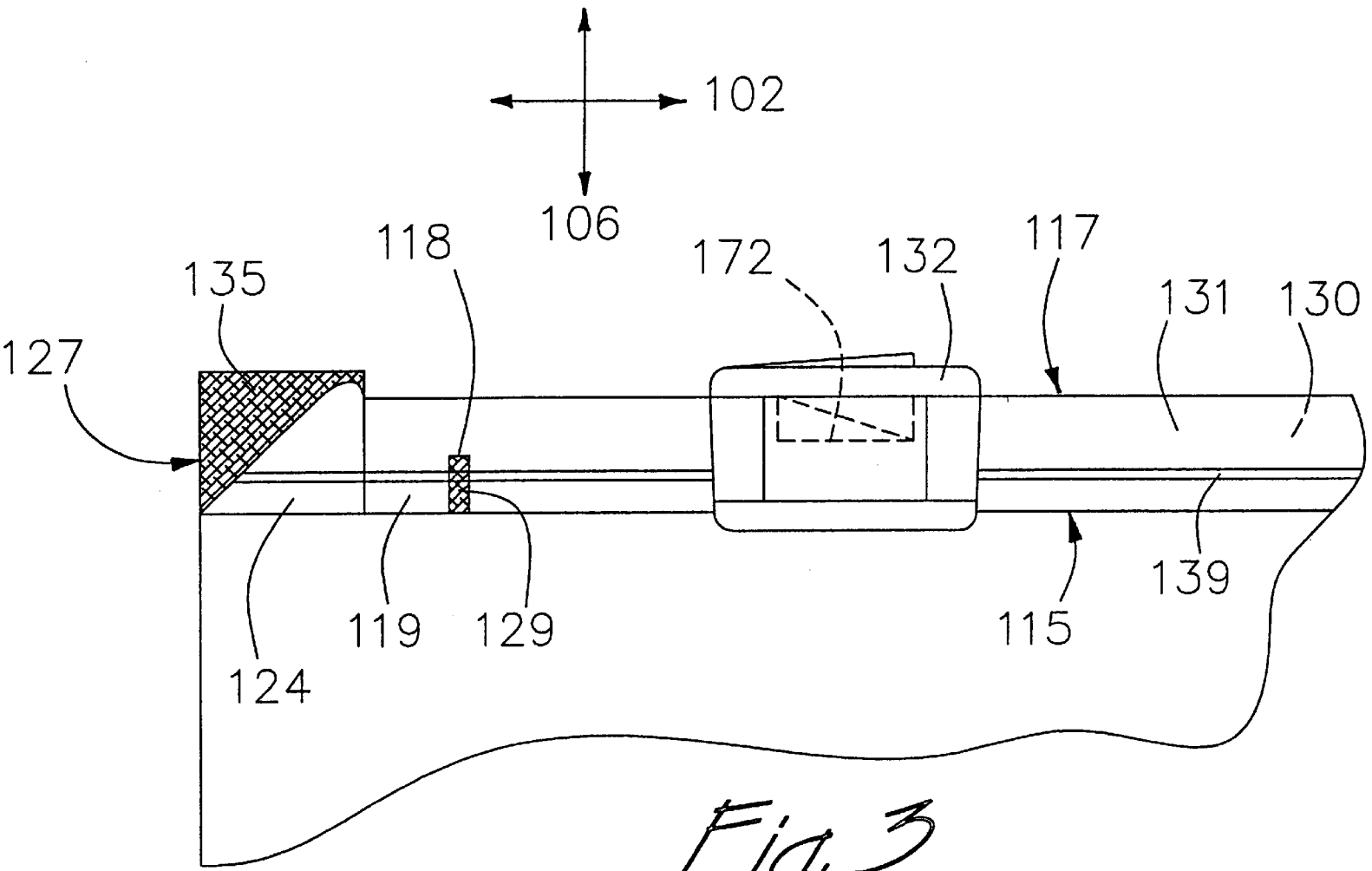
FIG. 3 is a fragmentary side view of the container in FIG. 1, with the slider positioned in an intermediate position.

In accordance with the present invention, a second seal 129 that secures part of the fastening strips 130, 131 together is provided in close proximity to the first end 127. The second seal 129 is accomplished by heat sealing, ultrasonic sealing or other welding operation, but may alternatively be accomplished by any other method that binds the fastening strips together in proximity to the first end 127. For example, the second seal may be created by using an adhesive, or by mechanically crimping, such as, by cold forming. Referring to FIG. 3, the second seal is disposed in close proximity to the bottom edge 115 of the fastening strips 130, 131 and extends upward in the vertical Z axis to a point 118 which is between the bottom and top edges 115, 117 of the fastening strips. An unsecured portion 119 of the fastening strips 130, 131 may be disposed between the melted portion 135 of the first end 127 and the second seal 129. In one embodiment, the unsecured portion 119 is an unmelted portion.

The melted portion 135 of the first end 127 is wider near the top edge 117 of the fastening strips and narrower near the bottom edge 115 of the fastening strips. This leaves an unmelted triangular shaped portion 124 near the bottom edge 115 of the first end 127. Similarly, the melted portion 137 of the second end 128 is also wider near the top edge 117 of the fastening strips and narrower near the bottom edge 115 of the fastening strips. Similarly, this leaves an unmelted triangular shaped portion near the bottom edge 115 of the second end 128.

The slider 132 is slidably mounted on the fastening strips 130, 131 for movement between the first and second ends 127, 128. In use, the slider 132 facilitates the occlusion and deocclusion of the interlocking fastening strips 130, 131 when moved in the appropriate direction along the longitudinal X axis 102 of the fastening strips 130, 131. In particular, the slider 132 facilitates the occlusion of the interlocking fastening strips 130, 131 when moved towards a first end 127 thereof, and facilitates the deocclusion of the interlocking fastening strips 130, 131 when moved towards a second end 128 thereof. When the slider 132 is moved in an occlusion direction, as indicated by reference numeral 114 in FIGS. 1 and 2, closure of the fastening strips 130, 131 occurs. Conversely, when the slider 132 is moved in a deocclusion direction, as indicated by reference numeral 116, separation of the fastening strips 130, 131 occurs.

The interlocking fastening strips may be of any type or form including, for example: (1) U-channel fastening strips as best shown herein at FIGS. 5 and 6; (2) "arrowhead-type" fastening strips, as disclosed in U.S. Pat. Nos. 5,007,142 and 5,020,194; (3) "profile" fastening strips, as disclosed in U.S. Pat. No. 5,664,299; and/or (4) rolling action fastening strips as disclosed in U.S. Pat. No. 5,007,143. All of the above-identified patents and applications are hereby incorporated by reference in their entireties.

Figure 5:
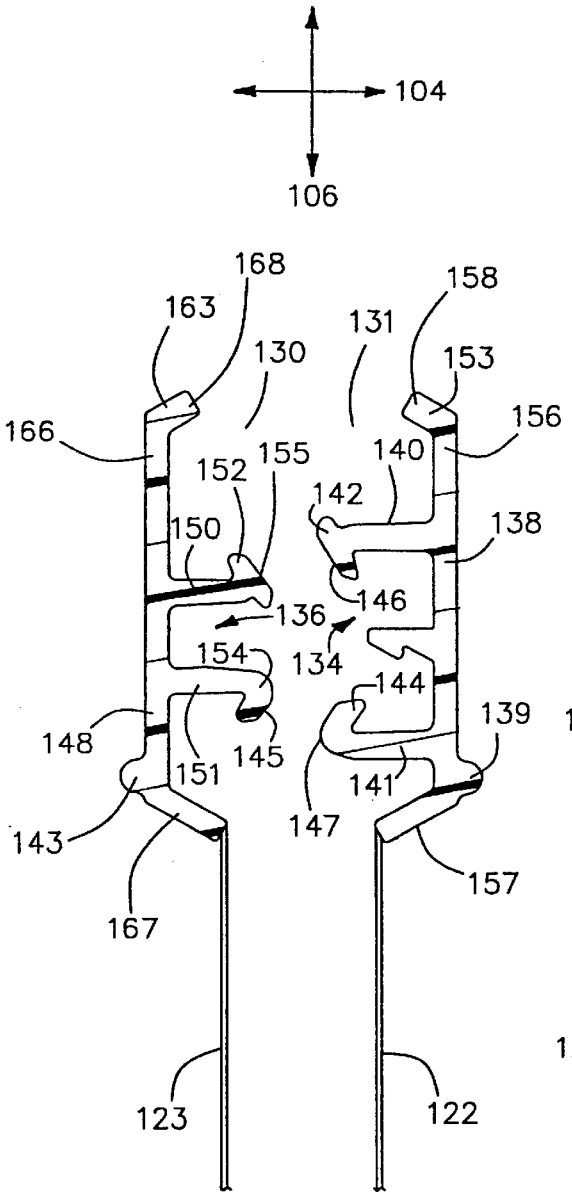
FIG. 5 is a partial cross-sectional view of the fastening strips taken along line 5—5 in FIG. 4.
Figure 6:
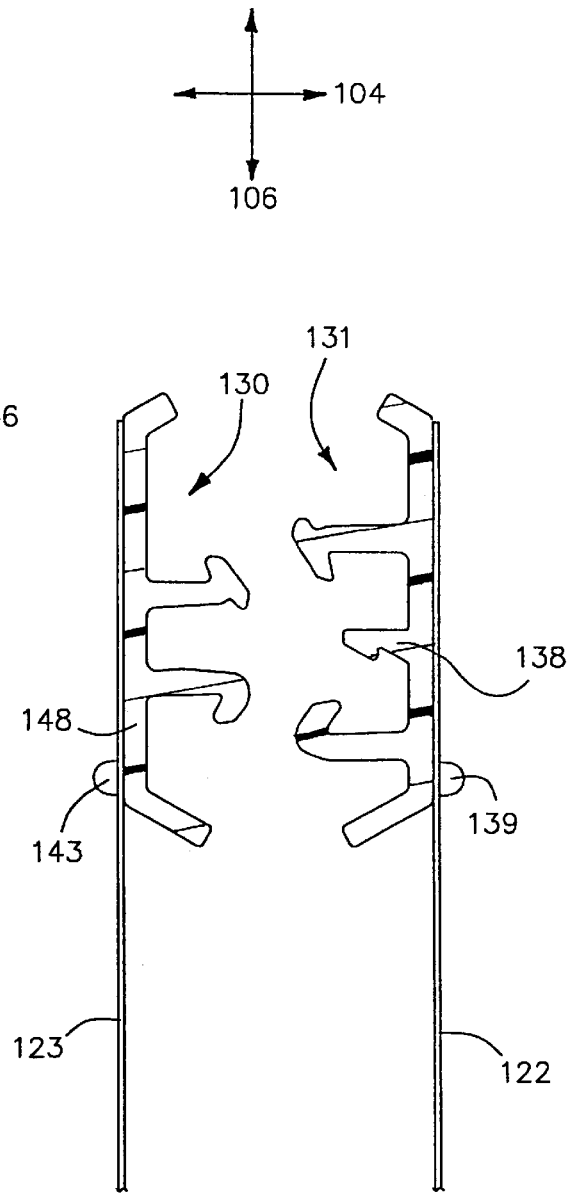
FIG. 6 is a partial cross-sectional view of exemplary fastening strips.

An illustrative example of the type of closure device that may be used with the present invention is shown in FIG. 5. The fastening strips include a first fastening strip 130 with a first closure element 136 and a second fastening strip 131 with a second closure element 134. The first closure element 136 engages the second closure element 134. The first fastening strip 130 may include an upper flange 163 disposed at the upper end of the first fastening strip 130 and a lower flange 167 disposed at the lower end of the first fastening strip 130. Likewise, the second fastening strip 131 may include an upper flange 153 disposed at the upper end of the second fastening strip 131 and a lower flange 157 disposed at the lower end of the second fastening strip 131. The upper flanges 163, 153 include a straight portion 166, 156 and an angled portion 168, 158. The angled portion 168, 158 is at an approximately 120 degree angle to the straight portion 166, 156. As shown in FIG. 5, the side walls 122, 123 of the plastic bag 120 may be attached to the lower flanges 167, 157 of their respective fastening strips 130, 131 by conventional manufacturing techniques. As shown in FIG. 6, the side walls 122, 123 of the bag 120 may also be attached to the outside surfaces of their respective fastening strips 130, 131.

Referring to FIGS. 5 and 6, the second closure element 134 includes a base portion 138 having a pair of spaced-apart parallely disposed webs 140, 141, extending from the base portion 138. The webs 140, 141 include hook closure portions 142, 144 extending from the webs 140, 141 respectively, and facing towards each other. The hook closure portions 142, 144 include guide surfaces 146, 147 which serve to guide the hook closure portions 142, 144 for occluding with the hook closure portions 152, 154 of the first closure element 136.

The first closure element 136 includes a base portion 148 including a pair of spaced-apart, parallely disposed webs 150, 151 extending from the base portion 148. The webs 150, 151 include hook closure portions 152, 154 extending from the webs 150, 151 respectively and facing away from each other. The hook closure portions 152, 154 include guide surfaces 145, 155, which generally serve to guide the hook closure portions 152, 154 for occlusion with the hook closure portions 142, 144 of the second closure element 134. The guide surfaces 145, 155 may also have a rounded crown surface. In addition, the hook closure portions 144, 154 may be designed so that the hook closure portions 144, 154 adjacent the interior of the container provide a greater resistance to opening the closure device 121.

Figure 2:
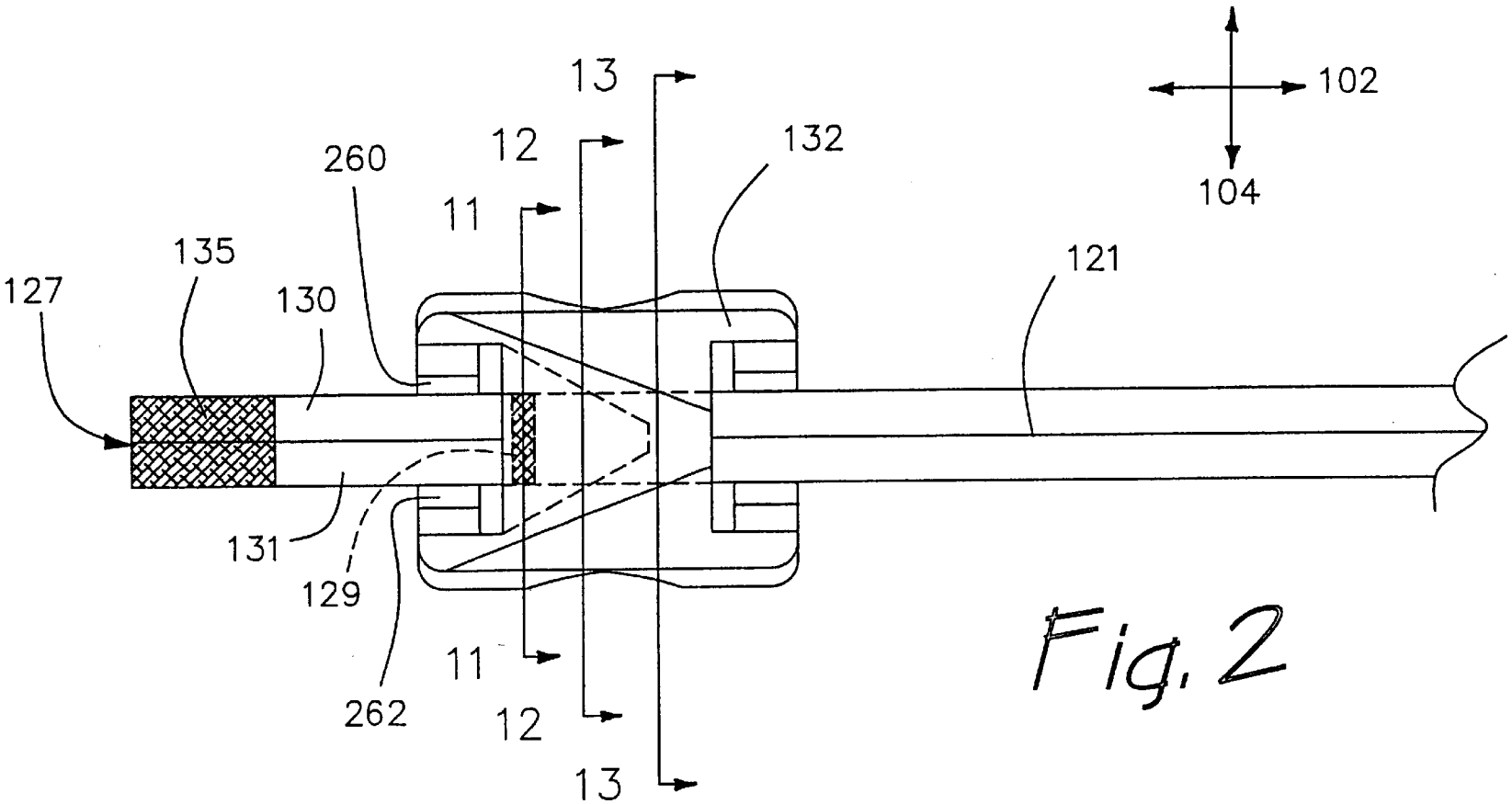
FIG. 2 is a top view of the container in FIG. 1.

As shown in FIGS. 1–6, the base portions 138, 148 of the closure elements 134, 136 also have respective guide rails 139, 143 that extend lineally along the longitudinal X axis 102. As shown in FIG. 5, the rails 139, 143 may be integrally formed with the fastening strips. As shown in FIG. 6, the rails 139, 143 may also be formed as an outward ridge on the surface of the bag sidewalls 122, 123 by conventional manufacturing techniques. In one embodiment, the guide rails 139, 143 are disposed in close proximity to the bottom edge 115 and run through the second seal 129, but may be disposed at any location between the top and bottom edges 115, 117. Referring to FIGS. 1–3, the guide rails 139, 143 are disrupted at the melted portions 135, 137 and at the second seal 129 by the melting process that secures the fastening strips 130, 131 together at those locations.

Figure 7:
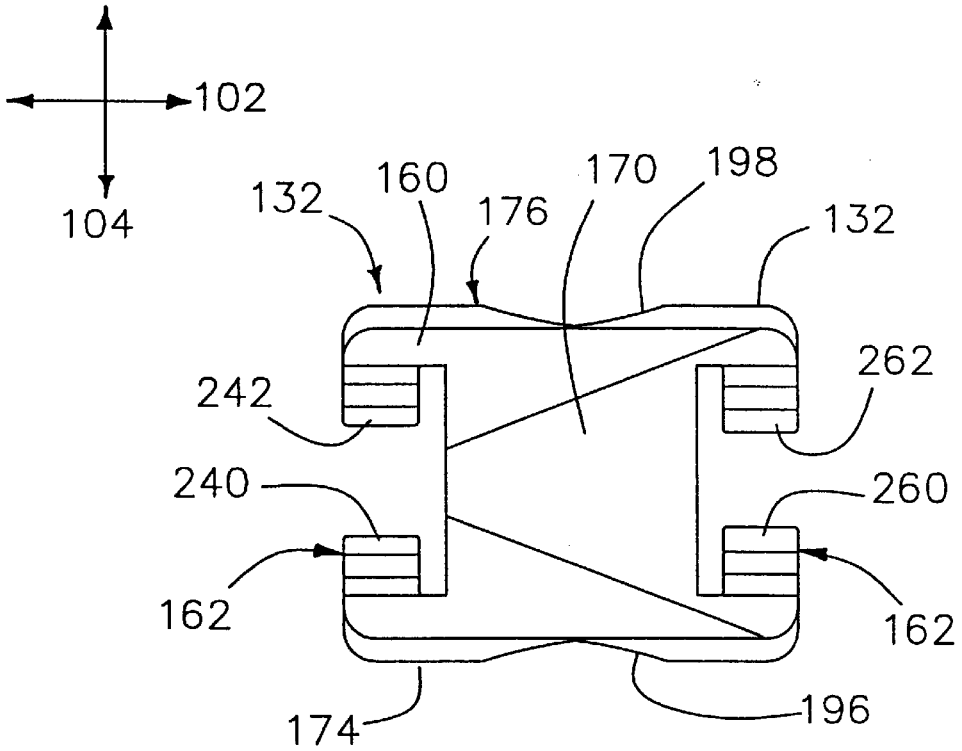
FIG. 7 is a top view of the slider in FIG. 2.
Figure 8:
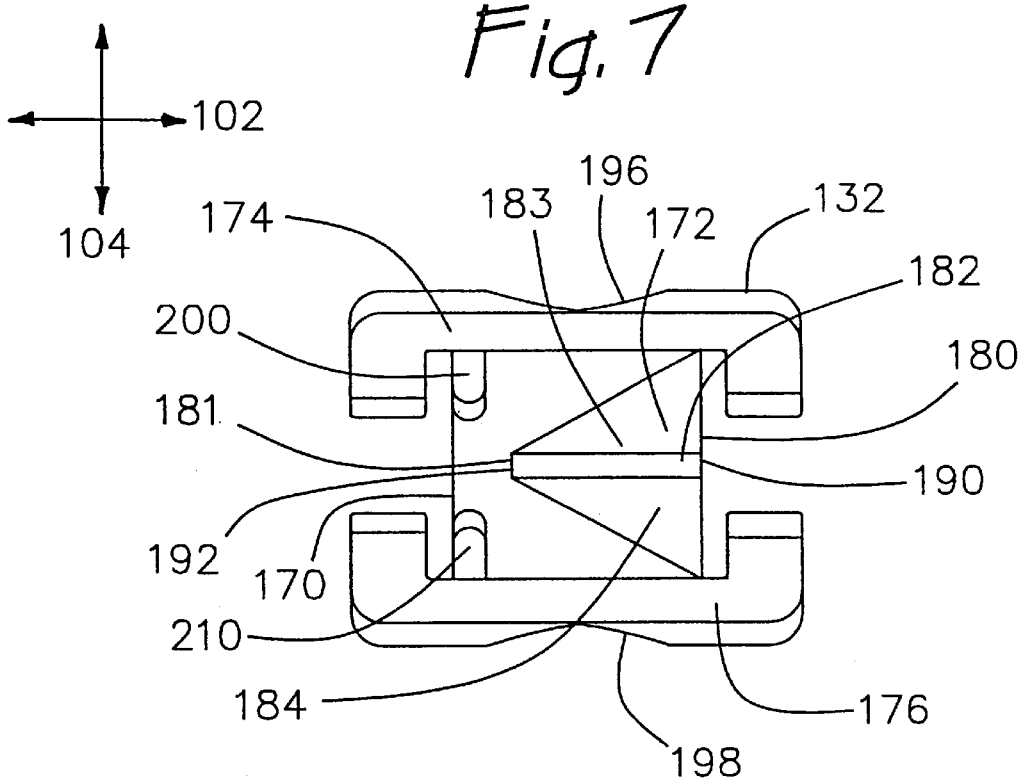
FIG. 8 is a bottom view of the slider in FIG. 2.

Referring to FIGS. 1–4 and 7–10 there is illustrated an exemplary slider 132 for use with the fastening strips. Referring to FIGS. 7–10, the slider 132 includes a housing 160 and an attaching means 162. The housing 160 may include a top portion 170, a first side portion 174, and a second side portion 176. The top portion 170 provides a separator 172 having a first end 190 and a second end 192 where the first end 190 is wider than the second end 192. The separator 172 is generally triangular in shape as shown in FIG. 8.

Figure 10:
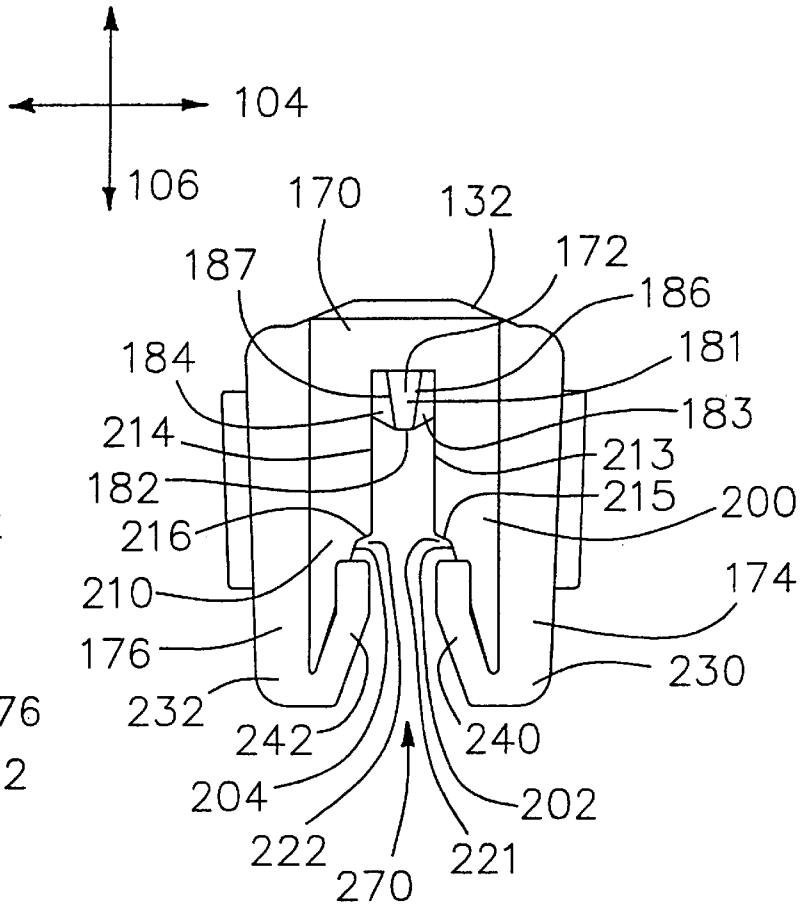
FIG. 10 is a front view of the slider in FIG. 2.
Figure 9:
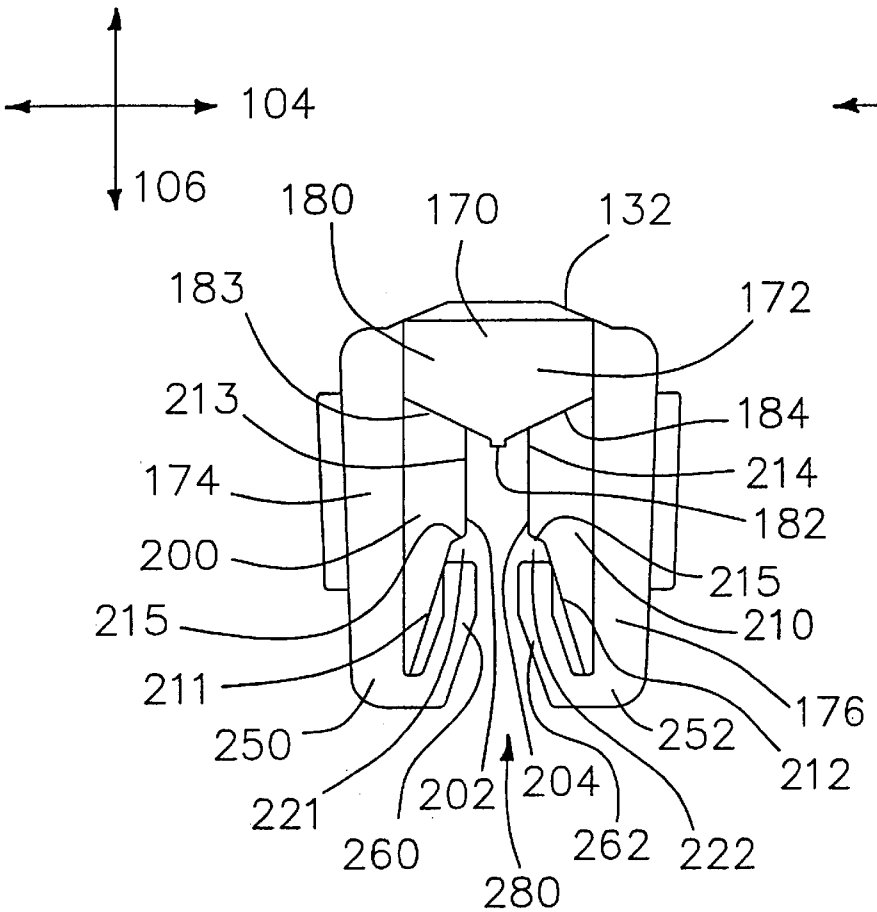
FIG. 9 is a rear view of the slider in FIG. 2.

Referring to FIGS. 8–10, the separator 172 has a first surface 180 at the first end 190 and a second surface 181 at the second end 192. The separator 172 has a bottom surface 182. Also, the separator 172 has a first side wall 183 and a second side wall 184 as shown in FIG. 8. The side walls 183, 184 generally angle inwardly from the first end 190 to the second end 192. The side walls 183, 184 also angle outwardly from the bottom surface 182 to the top portion 170 as shown in FIGS. 9 and 10.

The top portion 170 of the slider merges into the first side portion 174 and the second side portion 176. The first side portion 174 has a first grip 196 and a first occlusion member 200. Similarly, the second side portion 176 has a second grip 198 and a second occlusion member 210. The first grip 196 and the second grip 198 extend laterally along the outer surfaces of the side portions 174, 176 and provide inwardly protruding radial gripping surfaces designed to correspond to the contour of a person's fingertips as viewed in FIGS. 1, 7 and 8. The first and second grips 196, 198 facilitate grasping the slider 132 during occlusion or deocclusion of the fastening strips 130, 131. As shown in FIG. 1, the side portions 174, 176 straddle the fastening strips 130, 131 when inserted thereon, with the occlusion members 200, 210 engaging the fastening strips 130, 131.

The occlusion members 200, 210 oppose one another and force the fastening strips 130, 131 together to effectuate occlusion of the fastening strips 130, 131 when the slider is moved in the occlusion direction 114. The top portion 170 may be thick to provide reinforcement between the occlusion members 200, 210 to prevent the side portions 174, 176 from flexing during use. The occlusion members 200, 210 extend inward in the Y axis 104 from the side portions 174, 176 of the slider 132 towards the center of the slider. As viewed in FIGS. 9 and 10, the occluding members 200, 210 have inner surfaces 202, 204 which generally angle outwardly from the top portion 170 to the bottom of the slider 132 thus forming a V-shape. The inner surfaces 202, 204 also have differently angled portions, with respective lower portions 211, 212 that are angled more with respect to the Z axis 106 than respective upper portions 213, 214. The upper surface portions 213, 214 are substantially parallel with the Z axis 106 as shown in FIGS. 9 and 10. Each inner surface 202, 204, also provides a guide surface 215, 216, that offsets the upper and lower portions 211, 212, 213, 214.

During movement of the slider 132 towards the second end 128, the sidewalls 183, 184 of the separator 172 engage the upper flanges 156, 166 of the fastening strips 130, 131 to drive the upper ends of the fastening strips 130, 131 outward from one another. This causes interlocked web members 141, 151, 140, 150 to deocclude and separate which breaks the seal therebetween. During the slider's movement toward the second end 128, the narrower portion 192 of the separator will first engage the fastening strips 130, 131 followed by progressively wider portions including the widest portion 190 of the separator. Thus, the separator 172 operates as a wedge to drive the fastening strips 130, 131 outward from one another.

The attaching means 162 includes a pair of front flexible shoulders 230, 232, a pair of front legs 240, 242, a pair of rear flexible shoulders 250, 252, and a pair of rear legs 260, 262. As viewed in FIG. 10, the first side portion 174 merges into the first front leg 240 through the first front shoulder 230. Likewise, the second side portion 176 merges into the second front leg 242 through the second-front shoulder 232. The front legs 240, 242 angle inwardly in the transverse Y axis 104 thereby forming a front slot 270 of substantially uniform width as seen in FIGS. 7 and 8.

Similarly, as viewed in FIG. 9, the first side portion 174 merges into the first rear leg 260 through the first rear shoulder 250. Also, the second side portion 176 merges into the second rear leg 262 through the second rear shoulder 252. The rear legs 260, 262 angle inwardly in the transverse Y axis 104 thus forming a rear slot 280 of substantially uniform width. In a relaxed state, the legs 240, 242, 260, 262 of the slider 132 angle inwardly away from their respective side portions 174, 176 to form a void volume through which the legs 240, 242, 260, 262 may move outwardly in the transverse Y axis 104 during attachment of the slider 132 onto the fastening strips 130 131.

Each of the legs 240, 242, 260, 262 also provides a guide surface at their uppermost terminating end surface. The combination of the guide surfaces 215, 216 of the occlusion members 200, 202 and the guide surfaces of the legs 240, 242, 260, 262 form a pair of parallel guide tracks 221, 222 in the housing 160 aligned linearly with the longitudinal X axis 102. The guide tracks 221, 222 appear as a pair of channels when viewed from the front and rear in FIGS. 9 and 10. The guide tracks 221, 222 slidably engage the guide rails 139, 143 when the slider 132 is attached on the fastening strips 130, 131 to retain the slider 132 on the fastening strips 130, 131 in the Z axis.

In order to attach the slider 132 to the fastening strips 130, 131, the legs 240, 242, 260, 262 flex inward and then outward when the slider is moved vertically over the fastening strips 130, 131 in the Z axis. Once attached, the legs 240, 242, 260, 262 engage the guide rails 139, 143 to retain the slider slidably on the fastening strips 130, 131. It will be appreciated by those skilled in the art that the slider 132 may be molded from any suitable plastic material.

The slider facilitates proper orientation of the fastening strips within the slider during operation. Proper orientation of the fastening strips within the slider is usually accomplished by providing legs which support the respective fastening strips. The design of the slider is further dictated by the configuration of fastening strips utilized.

In accordance with the present invention, the second seal 129 provides for a leak proof container or bag 120. The second seal 129 resists the outward driving force of the separator 172 to hold the fastening strips 130, 131 together in a sealing relationship in close proximity to the first end 127. During movement of the slider 132 towards the first end from the position shown in FIG. 3 to that in FIG. 4, the separator 172 moves over the second seal 129. To prevent the legs 240, 242, 260, 262 of the slider 122 from disengaging the guide rails 139, 143, the width 270 of the second seal 129 (which disrupts the guide rail shape) in the X axis 102 is less than the width 272 of the legs in the X axis 102. Thus, an unmelted portion 119 is provided between the first end 127 and the second seal 129. For embodiments which do not use guide rails or where the guide rails are disposed above the second seal, the second seal may extend continuously along the bottom edge of the fastening strips to the melted portion 135 of the first end 127 without an unsecured or unmelted portion 119 therebetween.

Figure 4:
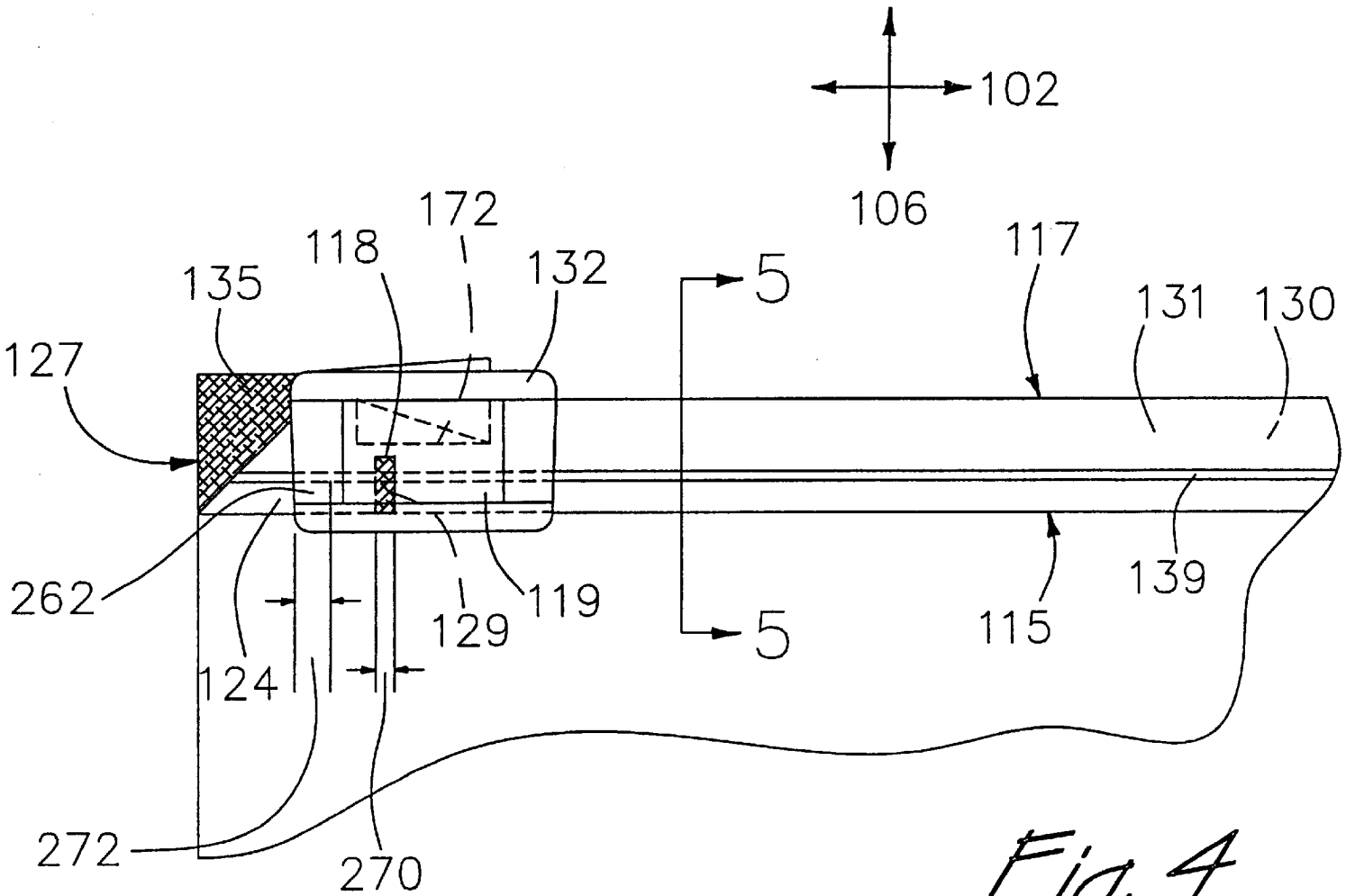
FIG. 4 is a fragmentary side view of the container in FIG. 1 with the slider at the end.
Figure 11:
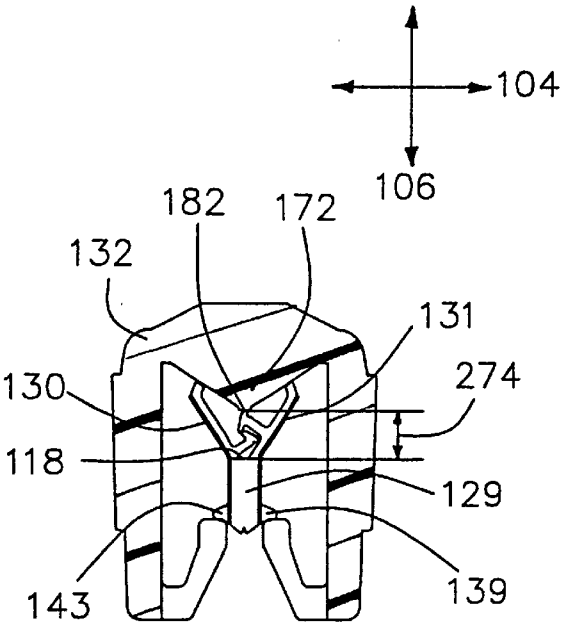
FIG. 11 is a section view of FIG. 2 taken about line 11—11.

As the slider 132 passes over the second seal 129, the wider end 190 of the separator 172 is the first portion of the separator 132 that moves over the second seal 129, as shown in FIGS. 2–4, and 11–13. Referring to FIG. 11, the wide end of the separator 172 bends or pivots the fastening strips 130, 131 about the top end 118 of the second seal 129. The resilient nature of the fastening strips 130, 131 allows for the bending to occur, which allows the slider 132 to pass over the second seal 129. Furthermore, the lower closure portions 144, 154 in the unmelted portion 119 remain occluded when the slider 132 passes over the second seal 129 and the slider is at the end position. Also shown in FIGS. 4 and 11 is that the bottom surface 182 of the separator 172 is separated by a clearance gap 274 from the top end 118 of the second seal 129 so that the separator 172 easily clears the second seal 129.

Figure 13:
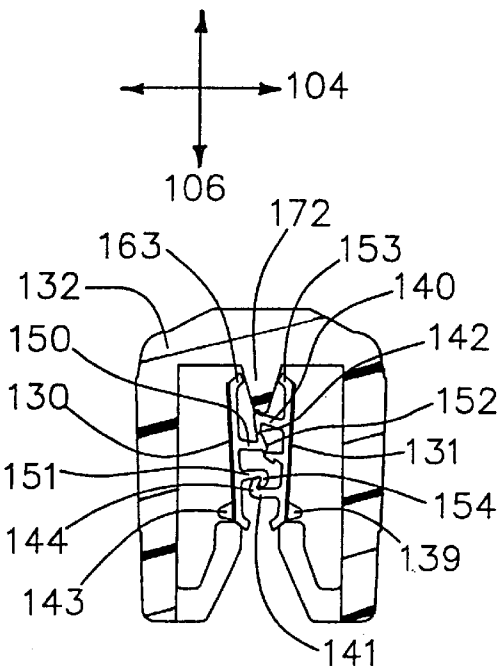
FIG. 13 is a section view of FIG. 2 taken about line 13—13.
Figure 12:
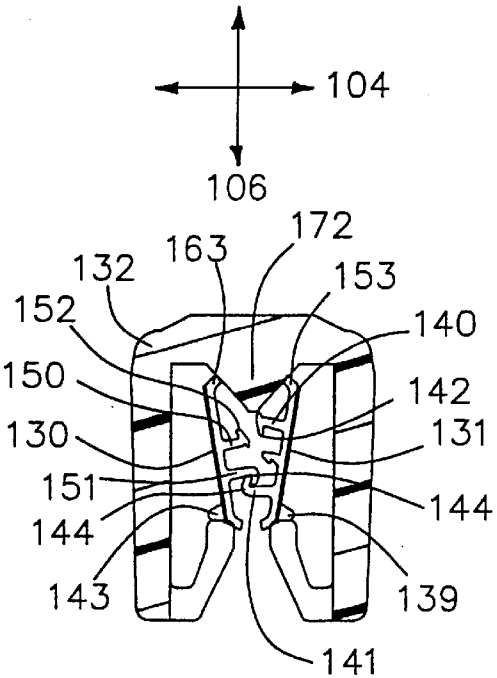
FIG. 12 is a section view of FIG. 2 taken about line 12—12.

Once the slider 132 is at the first end 127 as shown in FIG. 4, the top portion 170 of the slider 132 and/or the separator 172 of the slider 132 engage the melted portion 135 at the first end 127 to prevent the slider 132 from moving further in the closing direction 114. FIGS. 2 and 4 show the slider 132 in the end position of the fastening strips 130, 131 near the seam 127. FIGS. 11–13 illustrate occlusion of the fastening strips in the end position. These figures demonstrate that the closure device will have a leak proof seal when the slider is in the end position. The leak proof seal is created even though the separator extends between the flanges 153, 163.

As shown in FIG. 11, the second seal 129 seals the bottom of the fastening strips 130, 131 together in sealing relationship. The second seal 129 fuses the bottom web members 141, 151 into a single mass. The resilient nature of the fastening strips 130, 131 allows the separator 172 to move past the second seal 129 while preventing the wide end 190 of the separator 172 from separating the second seal.

The positions of the fastening strips are effected not only by the forces acting upon them by the slider at a particular location but are also effected by the position of the fastening strips at locations before and after that particular location. Specifically, with respect to the position of the inner closure portions 141, 151 in FIG. 12, the position of the inner closure portions 141, 151 is effected by the second seal 129. At the second seal 129, the fastening strips 130, 131 are melted together which effectively,occludes the fastening strips. This occlusion of the fastening strips 130, 131 at the second seal 129 prevents separating action of the separator finger 172 from deoccluding the inner closure portions 141, 151 at the locations in FIGS. 12 and 13. Thus, the inner closure portions 141, 151 remain occluded even though the separator finger 172 is attempting to deocclude the inner closure portions. Consequently, the inner closure portions 141, 151 remain occluded through the length of the fastening strips and establish a leak proof seal through the length of the fastening strips when fully occluded. Furthermore, the length of the unsecured or unmelted portion 119 is selected to be short enough to prevent the wide end 190 of the separator 172 from deoccluding or forming a gap in the unsecured or unmelted portion 119 of the fastening strips.

In viewing FIGS. 2 and 4, it can be seen that the rear legs 260, 262 move past the melted portion 135. The triangular shaped bottom unmelted portion 124 receives the legs 260, 262 and advantageously still provides the guide rails 139, 141 to prevent the slider 132 from being removed in the vertical Z axis 106 from the first end 127.

Figure 14:
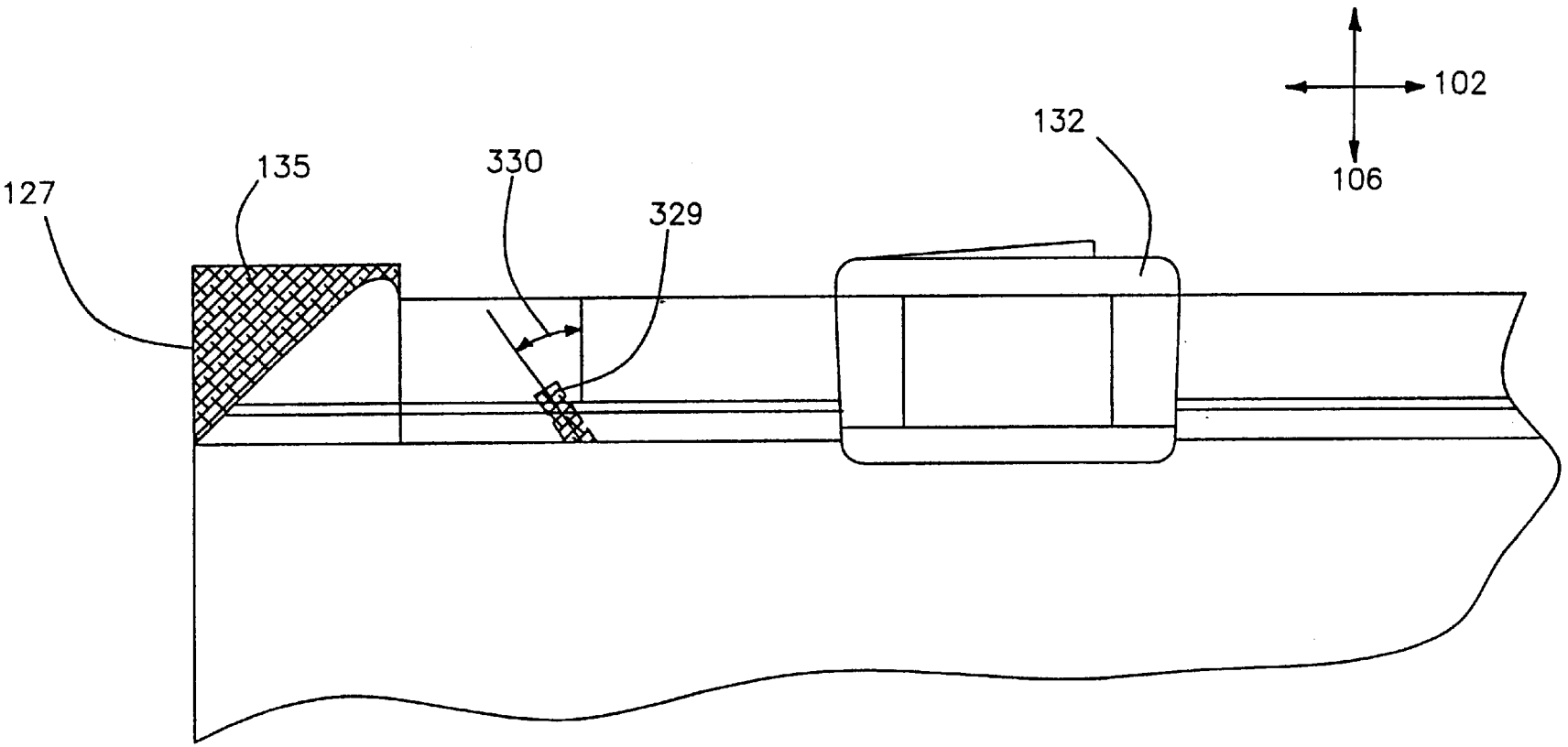
FIG. 14 is another embodiment of the closure device of the present invention.

As shown in FIGS. 1–3 the second seal 129 has a length that extends parallel with the Z axis. In the alternative embodiment of FIG. 14, it will be appreciated that other configurations or alignment of the second seal are available and included by the invention, such as a second seal 329 which is angled with respect to the Z axis 106. The second seal 329 is at an angle 330 which is 30 degrees from the vertical Z axis 106. The second seal may also be at an angle 330 in a first range of 0–80 degrees or a second range of 30–60 degrees.

Figure 15:
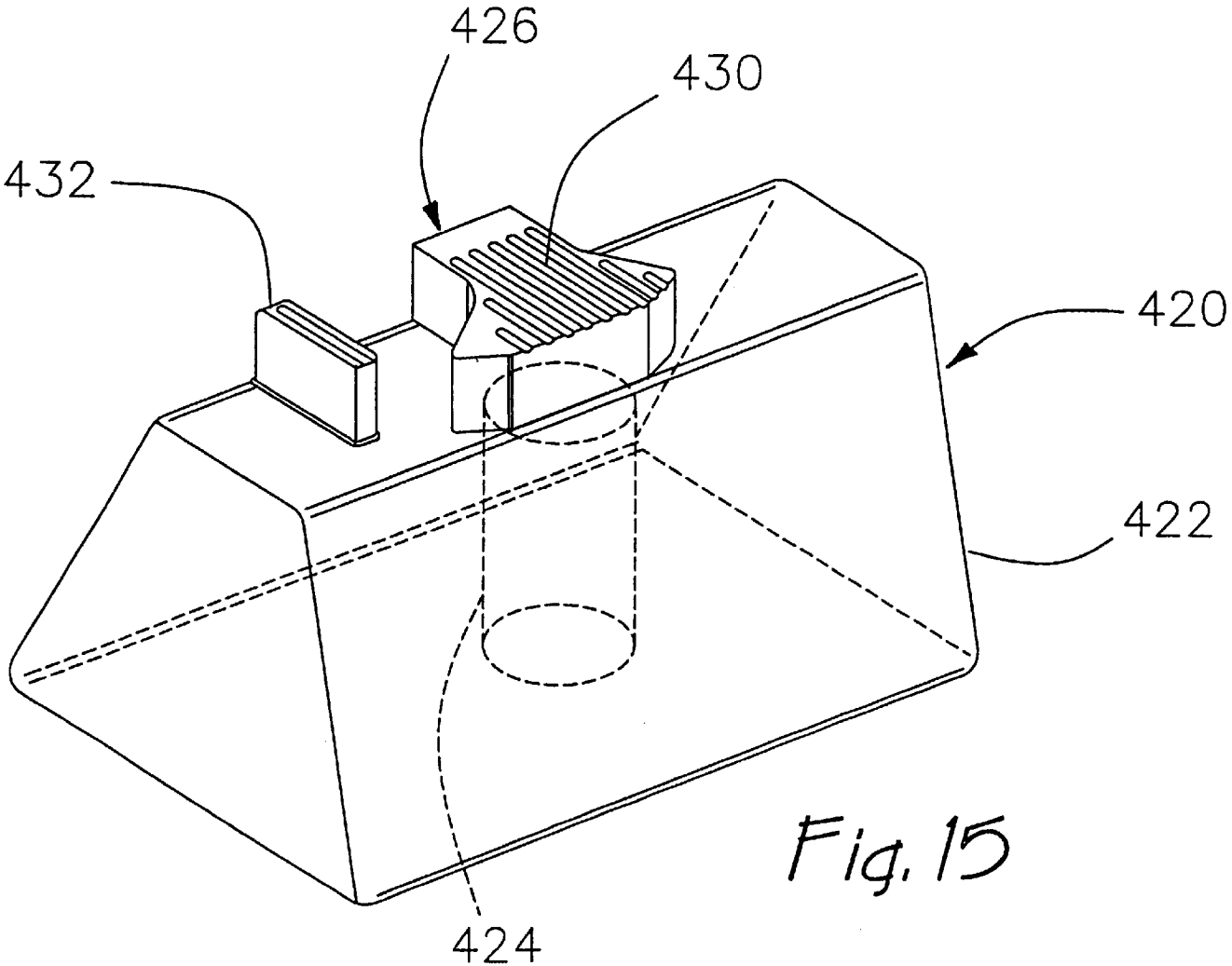
FIG. 15 is a perspective view of a heat sealing tool which may be used to secure the fastening strips of the present invention.
Figure 16:
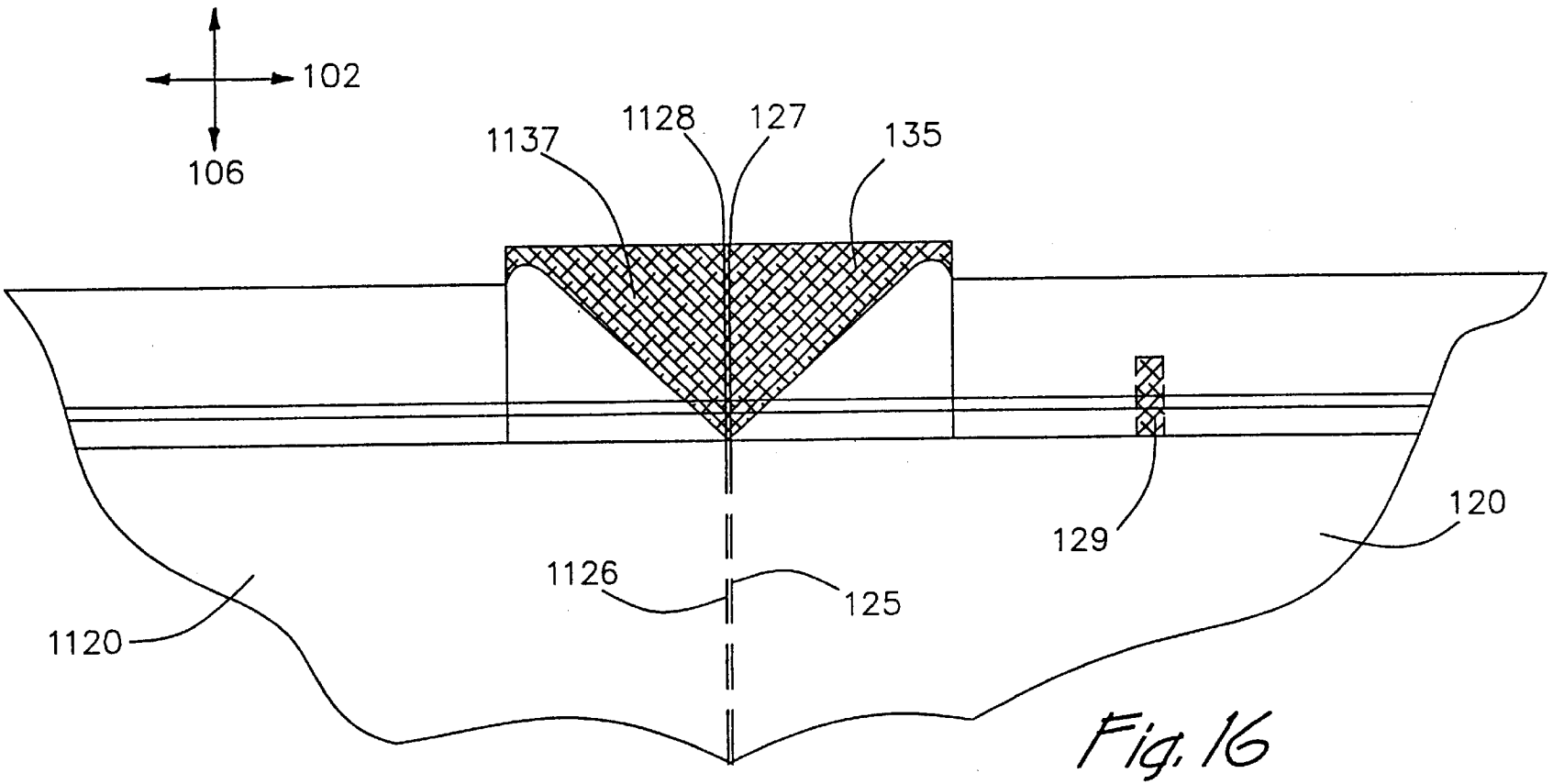
FIG. 16 is a fragmentary side view of bags and fastening strips that have been sealed with the tool of FIG. 15.

Turning to FIGS. 15 and 16, there is shown a heat sealing tool 420 for forming the seal 129 at the first end 127 and for forming the melted portions 135, 1137 at the first and second ends 127, 1128 of two different bags 120, 1120. The tool 420 includes a body 422 having a cavity 424 and a stamping face 426. The cavity 424 is connectable to the shaft of a machine for holding the tool 420 in alignment. The stamping face 426 includes a first fan shaped raised member 430 for forming melted portions 135, 1137 of the first and second ends 127, 1128 as well as a second raised portion 432 for forming the second seal 129. The heat sealing tool 420 conducts enough heat to melt the fastening strips 130, 131 together at the selected locations.

The adjacent bags 120, 1120 shown in FIG. 16 show adjacent fastening strips that have been heat sealed by the tool 420 illustrated in FIG. 15. As shown, the tool 420 is applied to two adjacent bags 120, 1120 before the bags 120, 1120 have been separated at the future location of the seams 125, 1126. The seams 125, 1126 will be formed after the tool 420 has been applied to the continuous strip which creates the bags 120, 1120. An advantage of the heat sealing tool of FIG. 15 is that the second seal 129 is formed at the same time as the melted portions 135, 1137 of adjacent fastening strips for two different bags 120, 1120. This provides for an easy, less expensive manufacturing process which provides a reliable way for providing a container or bag.

Although several interlocking fastening strip embodiments have been specifically described and illustrated herein, it will be readily appreciated by those skilled in the art that other kinds, types, or forms of fastening strips may alternatively be used without departing from the scope or spirit of the present invention.

The interlocking fastening strips may be manufactured by extrusion through a die. In addition, the fastening strips may be manufactured to have approximately uniform cross-sections. This not only simplifies the manufacturing of a closure device, but also contributes to the physical flexibility of the closure device.

Generally, the interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips of the present invention. In most instances, the fastening strips are made from low density polyethylene. The selection of the appropriate thermoplastic material, however, is related to the particular design of the fastening strips, the Young's Modulus of the thermoplastic material, and the desired elasticity and flexibility of the strips.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. In most instances, the bag is made from a mixture of high pressure, low density polyethylene and linear, low density polyethylene.

The fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the closure device or expected additional manufacturing operations.

Generally, the closure device can be manufactured in a variety of forms to suit the intended use. The closure device may be integrally formed on the opposing side walls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene). The selection of the material may be determined by the characteristics to be achieved by the slider.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. Indeed, the following claims are intended to cover all modifications and variations that fall within the scope and spirit of the present invention. In addition, all references and copending applications cited herein are hereby incorporated by reference in their entireties.

What is claimed is:

1. A closure device, comprising:

first and second interlocking fastening strips arranged to be interlocked over a predetermined X axis between first and second ends, the fastening strips being secured together at the first and second ends;

a slider slidably disposed on the fastening strips for movement between the first and second ends, the slider facilitating occlusion of the fastening strips when moved towards the first end, the slider including a separator disposed intermediate the fastening strips, the separator facilitating the deocclusion of the fastening strips when the slider is moved towards the second end;

a second seal sealing the fastening strips together in close proximity to the first end, the second seal disposed in relation to the slider to allow the slider, when disposed at the first end, to move toward the second end without engaging the second seal; and wherein the separator is separated by a clearance gap from the second seal so that the separator easily clears the second seal when the slider moves toward the first end.

2. The closure device of claim 1 wherein the fastening strips are melted together at the second seal.

3. The closure device of claim 2 wherein the fastening strips include melted portions at the first and second ends, the fastening strips being melted together at the melted portions to thereby secure the fastening strips together at the first and second ends.

4. The closure device of claim 3 wherein the first and second fastening strips include an unmelted portion disposed between the first end and the second seal.

5. The closure device of claim 3 wherein the second seal has a length that is parallel with a Z axis, the Z axis being perpendicular with the X axis.

6. The closure device of claim 3 wherein the second seal has a length that is angled with respect to a Z axis, the Z axis being perpendicular with the X axis.

7. The closure device of claim 3 wherein the fastening strips have a top edge and a bottom edge, the first fastening strip including a first guide rail extending in the predetermined X axis between the top and bottom edges, the second fastening strip including a second guide rail extending in the predetermined X axis between the top and bottom edges, the slider engaging the guide rails to retain the slider over the top edge of the fastening strips.

8. The closure device of claim 7 wherein the melted portions of the first and second ends disrupt the shape of the guide rails, the melted portions being wider at the top edge than at the bottom edge to prevent the slider from disengaging the guide rails when the slider is at the first and second ends.

9. The closure device of claim 8 wherein the guide rails are disposed in close proximity to the bottom edge, the second seal extending from the bottom edge to a point intermediate the top and bottom edges, the guide rails extending through the second seal, the shape of the guide rails being disrupted at the second seal.

10. The closure device of claim 1 wherein the slider includes a top portion and first and second side portions, the top portion disposed intermediate the side portions, the top portion providing the separator, the first side portion having a first flexible leg, the second side portion having a second flexible leg, the flexible legs extending inward toward each other and upward toward the top portion, the fastening strips being disposed between the first and second side portions, the first fastening strip have a first guide rail extending in the predetermined X axis, the second fastening strip have a second guide rail extending in the predetermined X axis, the first and second flexible legs engaging the first and second guide rails, respectively; and wherein the second seal has a width in the X axis that is less that the width of the flexible legs in the X axis.

11. The closure device of claim 1 wherein the first closure element comprises a first top web and a first bottom web, the first top web spaced from the bottom web, the second closure element comprises a second top web and a second bottom web, the second top web spaced from the bottom web, the bottom webs being permanently sealed together at the second seal.

12. The closure device of claim 11 wherein the first and second top webs include respective hook closure portions that are adapted to be occluded and deoccluded, the first and second bottom webs include respective hook closure portions that are adapted to be occluded and deoccluded, and the respective hook closure portions of the top webs are adapted to be occluded and deoccluded at the second seal.

13. A container, comprising:

first and second sidewalls joined at seams to form a compartment with an opening;

first and second interlocking fastening strips respectively connected to the first and second side walls at the opening, the fastening strips being arranged to be interlocked over a predetermined X axis between first and second ends for completely closing the opening to thereby provide a leak-proof container, the fastening strips being secured together at the first and second ends;

a slider slidably disposed on the fastening strips for movement between the first and second ends, the slider facilitating occlusion of the fastening strips when moved towards the first end, the slider including a separator disposed intermediate the fastening strips, the separator facilitating the deocclusion of the fastening strips when the slider is moved towards the second end;

a second seal sealing the fastening strips together in close proximity to the first end, the second seal disposed in relation to the slider to allow the slider, when disposed at the first end, to move toward the second end without engaging the second seal; and wherein the separator is separated by a clearance gap from the second seal so that the separator easily clears the second seal when the slider moves toward the first end.

14. The container of claim 13 wherein the fastening strips are melted together at the second seal.

15. The container of claim 14 wherein the fastening strips include melted portions at the first and second ends, the fastening strips being melted together at the melted portions to thereby secure the fastening strips together at the first and second ends.

16. The container of claim 15 wherein the first and second fastening strips include an unmelted portion disposed between the first end and the second seal.

17. The container of claim 15 wherein the second seal has a length that is parallel with a Z axis, the Z axis being perpendicular with the X axis.

18. The container of claim 15 wherein the second seal has a length that is angled with respect to a Z axis, the Z axis being perpendicular with the X axis.

19. The container of claim 15 wherein the fastening strips have a top edge and a bottom edge, the first fastening strip including a first guide rail extending in the predetermined X axis between the top and bottom edges, the second fastening strip including a second guide rail extending in the predetermined X axis between the top and bottom edges, the slider engaging the guide rails to retain the slider over the top edge of the fastening strips.

20. The container of claim 19 wherein the melted portions of the first and second ends disrupt the shape of the guide rails, the melted portions being wider at the top edge than at the bottom edge to prevent the slider from disengaging the guide rails when the slider is at the first and second ends.

21. The container of claim 20 wherein the guide rails are disposed in close proximity to the bottom edge, the second seal extending from the bottom edge to a point intermediate the top and bottom edges, the guide rails extending through the second seal, the shape of the guide rails being disrupted at the second seal.

22. The container of claim 13 wherein the slider includes a top portion and first and second side portions, the top portion disposed intermediate the side portions, the top portion providing the separator, the first side portion having a first flexible leg, the second side portion having a second flexible leg, the flexible legs extending inward toward each other and upward toward the top portion, the fastening strips being disposed between the first and second side portions, the first fastening strip have a first guide rail extending in the predetermined X axis, the second fastening strip have a second guide rail extending in the predetermined X axis, the first and second flexible legs engaging the first and second guide rails, respectively; and wherein the second seal has a width in the X axis that is less that the width of the flexible legs in the X axis.

23. The container of claim 13 wherein the first closure element comprises a first top web and a first bottom web, the first top web spaced from the bottom web, the second closure element comprises a second top web and a second bottom web, the second top web spaced from the bottom web, the bottom webs being permanently sealed together at the second seal.

24. The container of claim 23 wherein the first and second top webs include respective hook closure portions that are adapted to be occluded and deoccluded, the first and second bottom webs include respective hook closure portions that are adapted to be occluded and deoccluded, and the respective hook closure portions of the top webs are adapted to be occluded and deoccluded at the second seal.

25. A method of manufacturing a closure device, comprising:

arranging first and second interlocking fastening strips to be interlocked over a predetermined X axis between first and second ends;

securing the fastening strips together at the first and second ends;

slidably disposing a slider on the fastening strips for movement between the first and second ends, the slider facilitating occlusion of the fastening strips when moved towards the first end, the slider including a separator disposed intermediate the fastening strips, the separator facilitating the deocclusion of the fastening strips when the slider is moved towards the second end;

sealing the fastening strips together in close proximity to the first end to define a second seal, the second seal disposed in relation to the slider to allow the slider, when disposed at the first end, to move toward the second end without engaging the second seal; and wherein the separator is separated by a clearance gap from the second seal so that the separator easily clears the second seal when the slider moves toward the first end.

26. The method of claim 25 wherein the fastening strips are melted together at the second seal.

27. The method of claim 26 wherein the fastening strips include melted portions at the first and second ends, the fastening strips being melted together at the melted portions to thereby secure the fastening strips together at the first and second ends.

28. The method of claim 27 wherein the first and second fastening strips include an unmelted portion disposed between the first end and the second seal.

29. The method of claim 25 wherein the first closure element comprises a first top web and a first bottom web, the first top web spaced from the bottom web, the second closure element comprises a second top web and a second bottom web, the second top web spaced from the bottom web, the bottom webs being permanently sealed together at the second seal.

30. The method of claim 29 wherein the first and second top webs include respective hook closure portions that are adapted to be occluded and deoccluded, the first and second bottom webs include respective hook closure portions that are adapted to be occluded and deoccluded, and the respective hook closure portions of the top webs are adapted to be occluded and deoccluded at the second seal.

* * * * *